US007207637B2

(12) United States Patent
Huang

(10) Patent No.: US 7,207,637 B2
(45) Date of Patent: Apr. 24, 2007

(54) COUPLING APPARATUS FOR A SIDE PANEL AND A FACE PANEL OF DRAWERS

(75) Inventor: Ting-Tsai Huang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/819,138

(22) Filed: Apr. 7, 2004

(65) Prior Publication Data

US 2005/0225220 A1 Oct. 13, 2005

(51) Int. Cl.
*A47B 88/00* (2006.01)

(52) U.S. Cl. ..... 312/348.4; 312/263

(58) Field of Classification Search ..... 312/348.4, 312/330.1, 348.1, 263, 348.2; 403/406.1, 403/407.1, 322.1, 321, 388, 389, 326, 330; 292/303, 247, 249, 219, 226, DIG. 11, DIG. 61
See application file for complete search history.

(56) References Cited

U.S. PATENT DOCUMENTS 2,648,585 A * 8/1953 Straubel ..... 312/348.4
5,364,181 A * 11/1994 Scheible ..... 312/348.4
5,611,637 A * 3/1997 Brustle et al. ..... 312/348.4
5,664,857 A * 9/1997 Lautenschlager et al. ..... 312/330.1
5,860,718 A * 1/1999 Brustle ..... 312/330.1
5,895,103 A * 4/1999 Huber ..... 312/348.4
6,027,194 A * 2/2000 Fleisch ..... 312/348.4
6,179,399 B1 1/2001 Brüstle et al.
2004/0000849 A1 1/2004 Lam Harn et al.
2004/0000852 A1* 1/2004 Lam Harn et al. ..... 312/348.4

FOREIGN PATENT DOCUMENTS

EP 581325 * 2/1994 ..... 312/348.4

* cited by examiner

*Primary Examiner*—Lanna Mai
*Assistant Examiner*—Hanh V. Tran
(74) *Attorney, Agent, or Firm*—Birch, Stewart, Kolasch & Birch, LLP

(57) ABSTRACT

A coupling apparatus for a side panel and a face panel of drawers includes an elastic coupling assembly that has a base plate with first pivot lugs to receive a pin and couple with a torsional spring, a clip frame having second pivot lugs corresponding to the first pivot lugs to pivotally couple with the base plate and receive an elastic force from the torsional spring so that the clip frame and the base plate are clamped and closed constantly on the opening side. The clip frame has a stopping flange on an inner side, and the side panel of the drawer has a ridge latchable with the stopping flange for anchoring. The clip frame and the base plate may be pried open on the clamped side to couple on the side panel, then close and clamp automatically.

4 Claims, 6 Drawing Sheets

COUPLING APPARATUS FOR A SIDE PANEL AND A FACE PANEL OF DRAWERS

FIELD OF THE INVENTION

The present invention relates to a drawer having a side panel and a face panel coupled by a coupling apparatus and particularly to an elastic clip device that is pivotally fastened to the face panel of a drawer to rapidly couple with the side panel.

BACKGROUND OF THE INVENTION

The design of conventional metal drawers, in order to meet the growing trend of DIY assembly and facilitate rapid assembly of vendors, generally aims to make assembly of the side panels, face panel and bottom panel as easy as possible. For instance, U.S. Pat. No. 6,179,399 discloses a structure for coupling a face panel with a side panel. Referring to drawings 29 through 39 of that patent, it mainly includes a coupling assembly. The assembly 3 includes a longitudinal panel 9, which has apertures 32 on two ends to receive bolts for fastening to a wooden face panel. For assembly of the face panel, the assembly 3 is coupled on a side panel 5 of the drawer. The coupling structure of the assembly 3 and the side panel 5 includes a base plate 8 formed by bending and extending one side of the longitudinal panel 9. The base plate 8 has a pivot seat 12 to pivotally couple with a bracket 120. The bracket 120 is riveted to a case plate 10. The pivot seat 12 also holds an elastic reed 11. The bracket 120 has a pivot end extended to form a bucking section 38. In order to adjust the elevation of the face panel to match the clamped position of the side panel of the drawer, the base plate 8 has a turning knob 13 equipped with a cam. The cam can push the coupling edge of the side panel 5 to adjust the relative assembly position. Moreover, the side panel 5 further has a notch 6 corresponding to the pivot seat 12. There is a protrusive section 18 formed on a lower side of the front edge in the notch 6 and a trough formed in the inner side thereof corresponding to the turning knob 13. The notch 6 further has a vertical notch 7 formed on the inner side to enable the elastic reed 11 to be coupled between the notch 6 and the vertical notch 7. The bracket 120 is extended to form a lug to reach the vertical notch 7. The structure set forth above has a base plate 8 and a case plate 10, forming an opening to couple in the notch 6. By pressing the case plate 10 to compress the elastic reed 11 through the bucking section 38 at one end of the bracket 120, a clamping force may be generated to grip the side panel 5 of the drawer. And the lug extended from the bracket 120 can engage with the vertical notch 7 to form anchoring.

The conventional apparatus for coupling and clamping the side panel of the drawer mentioned above has a complicated structure. It requires a great number of elements and riveting operations. The elements also are formed in complicated shapes and difficult to match with one another. Hence the fabrication cost is higher, and production yield is lower. There is still room for improvement.

SUMMARY OF THE INVENTION

In view of the foregoing advantages, the object of the invention is to provide a drawer having a side panel and a face panel coupled by a coupling apparatus that has elements pivotally mounting on the face panel of a drawer to rapidly couple with the side panel through an elastic clip.

In one aspect of the invention, a base plate is provided that has a pair of first pivot lugs formed by stamping to receive a pin, to couple with a clip frame that has a pair of corresponding second pivot lugs. The pivot lugs, pin and clip frame have a pivotal coupling section to couple with a torsional spring. The torsional spring exerts an action force to the clip frame to make the opening side of the clip frame and base plate in a clamped and closed condition constantly. On one side of the clip frame opposite to the clamped side that is subject to an inverse levering force, there is a tool notch to receive a hand tool to wedge and open the clamped side. The clip frame has a stopping flange on an inner side, and the drawer side panel has a ridge formed by stamping. When the clip frame is in the clamped condition, the stopping flange is latched on the ridge for anchoring. Thus applying a force, the clip frame and the base plate is pried opened to couple the side panel of the drawer and automatically return to the clamped condition.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
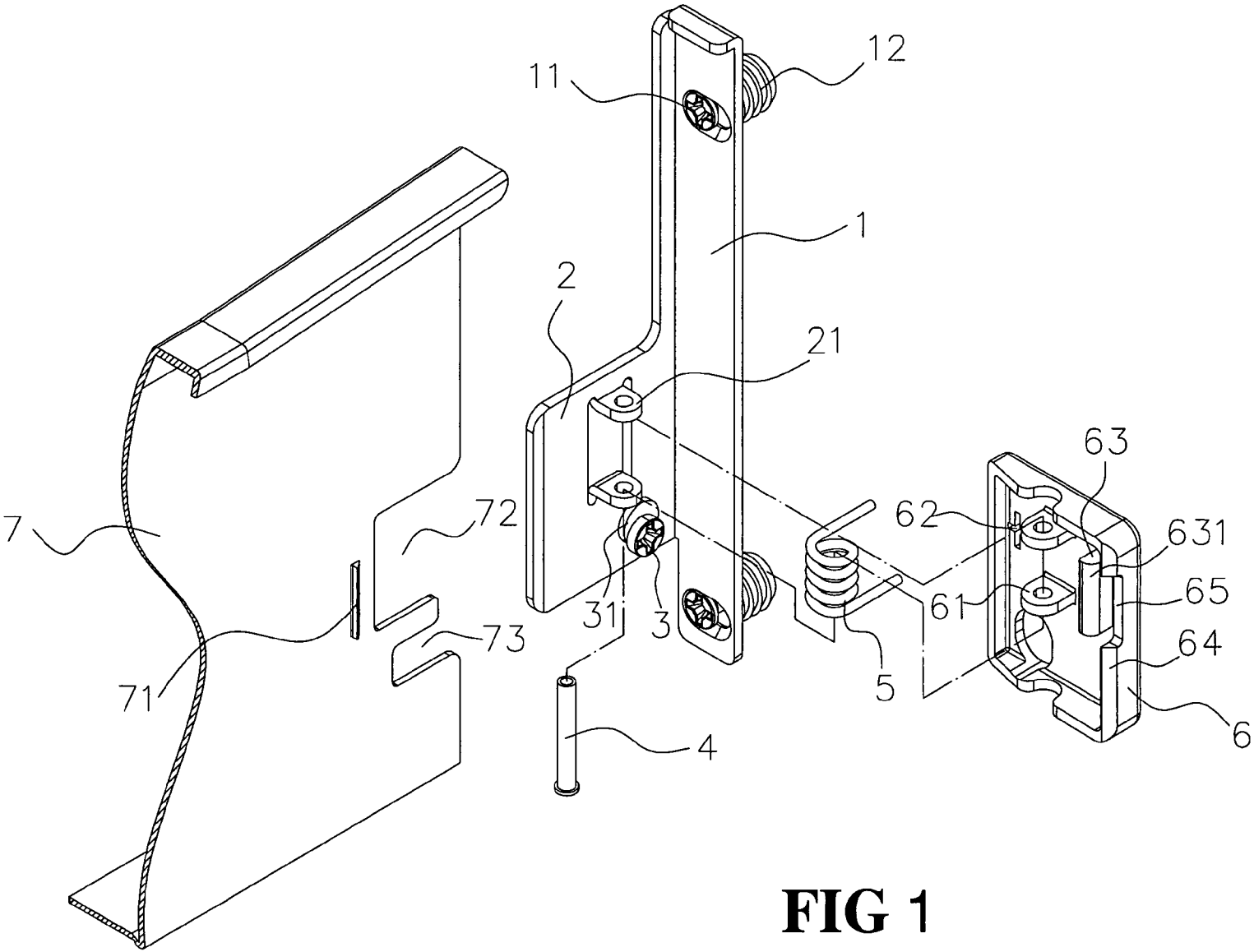
FIG. 1 is an exploded view of the embodiment of the invention.
Figure 2:
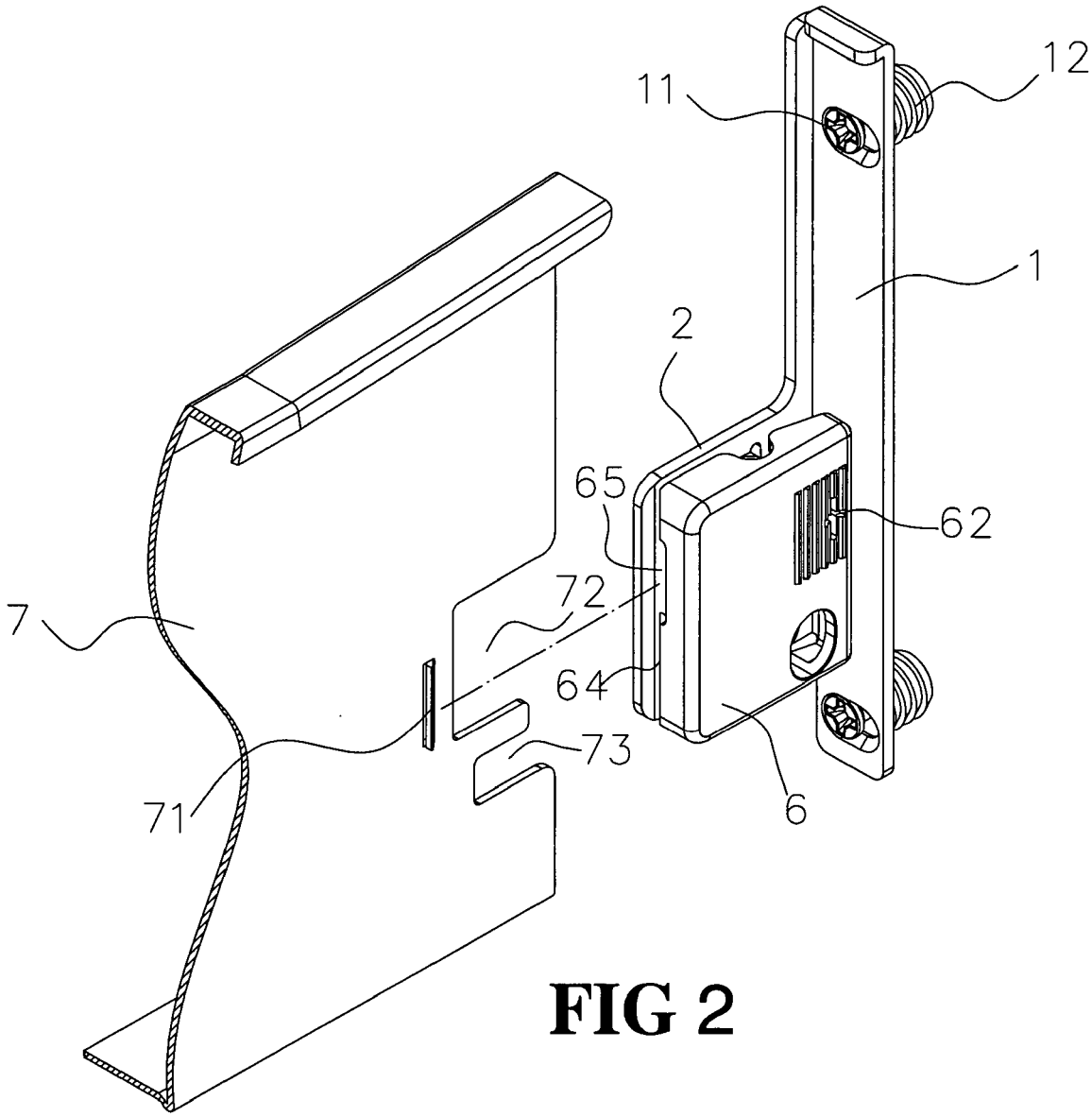
FIG. 2 is a fragmentary schematic view of the embodiment of the invention.

Referring to FIGS. 1 and 2, the drawer having a side panel and a face panel coupled by a coupling apparatus according to the invention has a longitudinal panel 1 like the conventional apparatus. The panel 1 has two ends penetrating by screws 11 to fasten to anchor struts 12 for sinking into sunken bores of a wooden face panel (not shown in the drawings. The fastening technique forms no part of the invention, thus is omitted in the detailed discussion). The longitudinal panel 1 has one side bent and is extended to form a base plate 2. On the base plate 2, there is a turning knob 3 located on a desired position and equipped with a cam 31.

The base plate 2 further has a pair of first pivot lugs 21 formed by stamping to receive a pin 4 and couple with a torsional spring 5. A clip frame 6 is provided to pivotally couple with the base plate 2 and has a size corresponding to the base plate 2.

Figure 6:
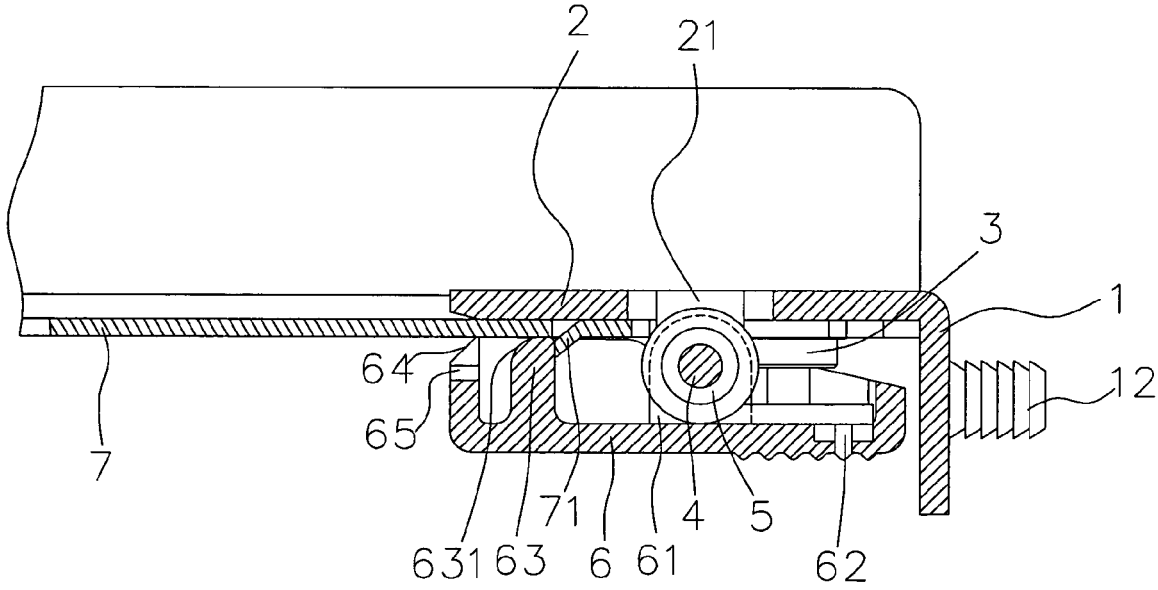
FIG. 6 is a sectional view of the embodiment of the invention after being assembled.

The clip frame 6 has a pair of second pivot lugs 61 corresponding to the first pivot lugs 21. The torsional spring 5 provides an elastic force to the base plate 2 and the pivot frame 6 so that the opening side of the clip frame 6 and the base plate 2 is in a clamped and closed condition constantly. The pivot frame 6 has a tool notch 62 on one side opposite to the clamped side that is subject to an inverse levering force, to receive a hand tool to pry and open the clip frame 6. It is to be noted that aside from the embodiment depicted in the drawings, any other means and techniques that can pry and open the clip frame 6 may also be adopted and shall be within the claim scope of the invention. The clip frame 6 has a stopping flange 63 on an inner side. The stopping flange 63 has an arched edge 631 on a front side and a sloped guiding edge 64 on a lateral side. The lateral side has a first notch 65 corresponding to the stopping flange 63. The drawer has a side panel 7, which has a ridge 71 formed by stamping. The stopping flange 63 may be latched on the ridge 71 in a clamped condition (referring to FIG. 6). In addition, the coupled clip frame 6 and the base plate 2 clamp the side panel 7. The coupling portion is slightly larger than the second notch 72 formed on the side panel 7 that has a width greater than the interval of the pivot lugs 21 and 61. There is a third notch 73 adjacent to the second notch 72 bucking by the cam 31 of the turning knob 3 so that the elevation of the clamp assembly formed by the clip frame 6 and the base plate 2 may be adjusted against the side panel 7.

Figure 3:
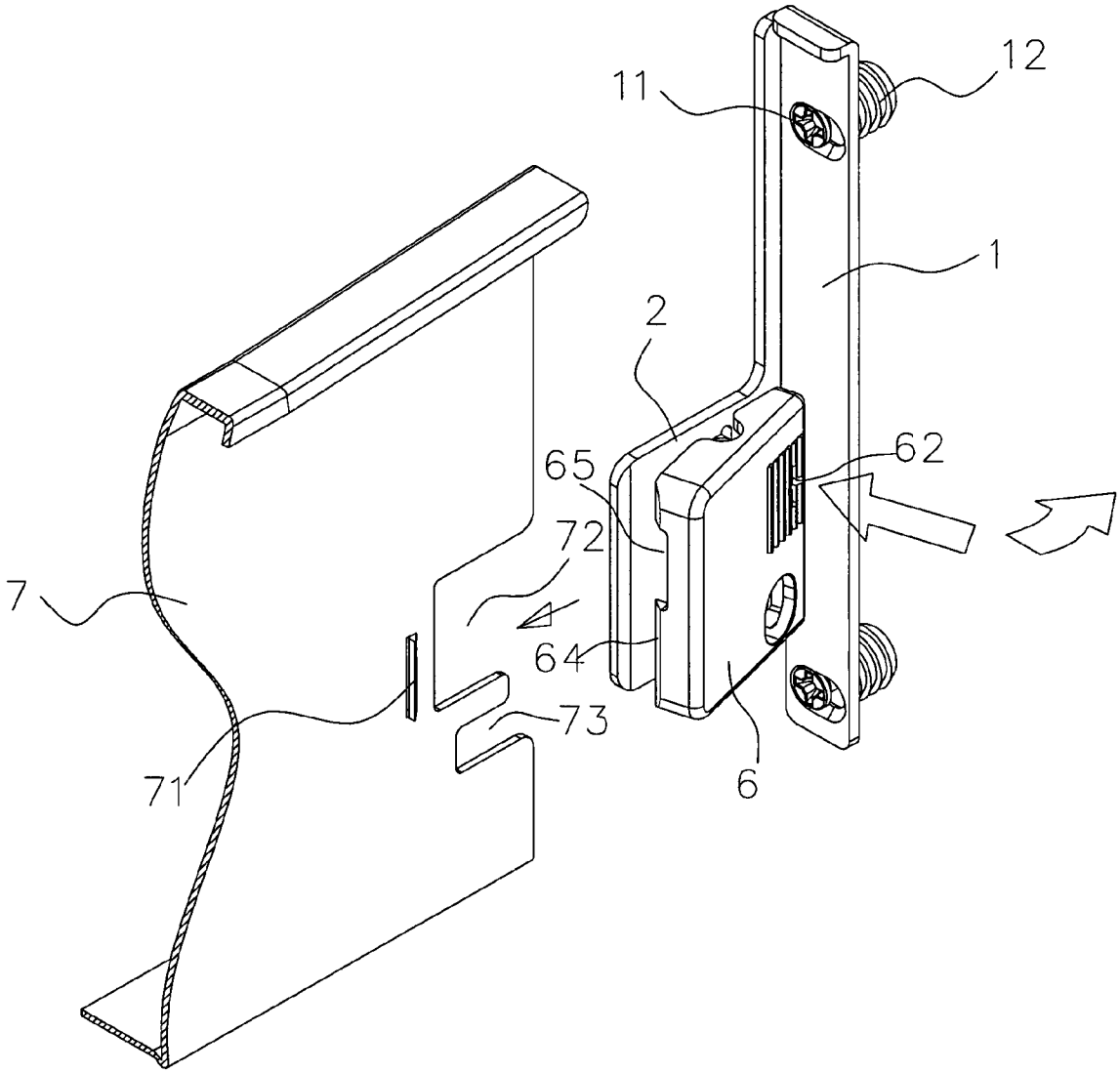
FIG. 3 is a schematic view of the embodiment of the invention in an assembly condition.
Figure 4:
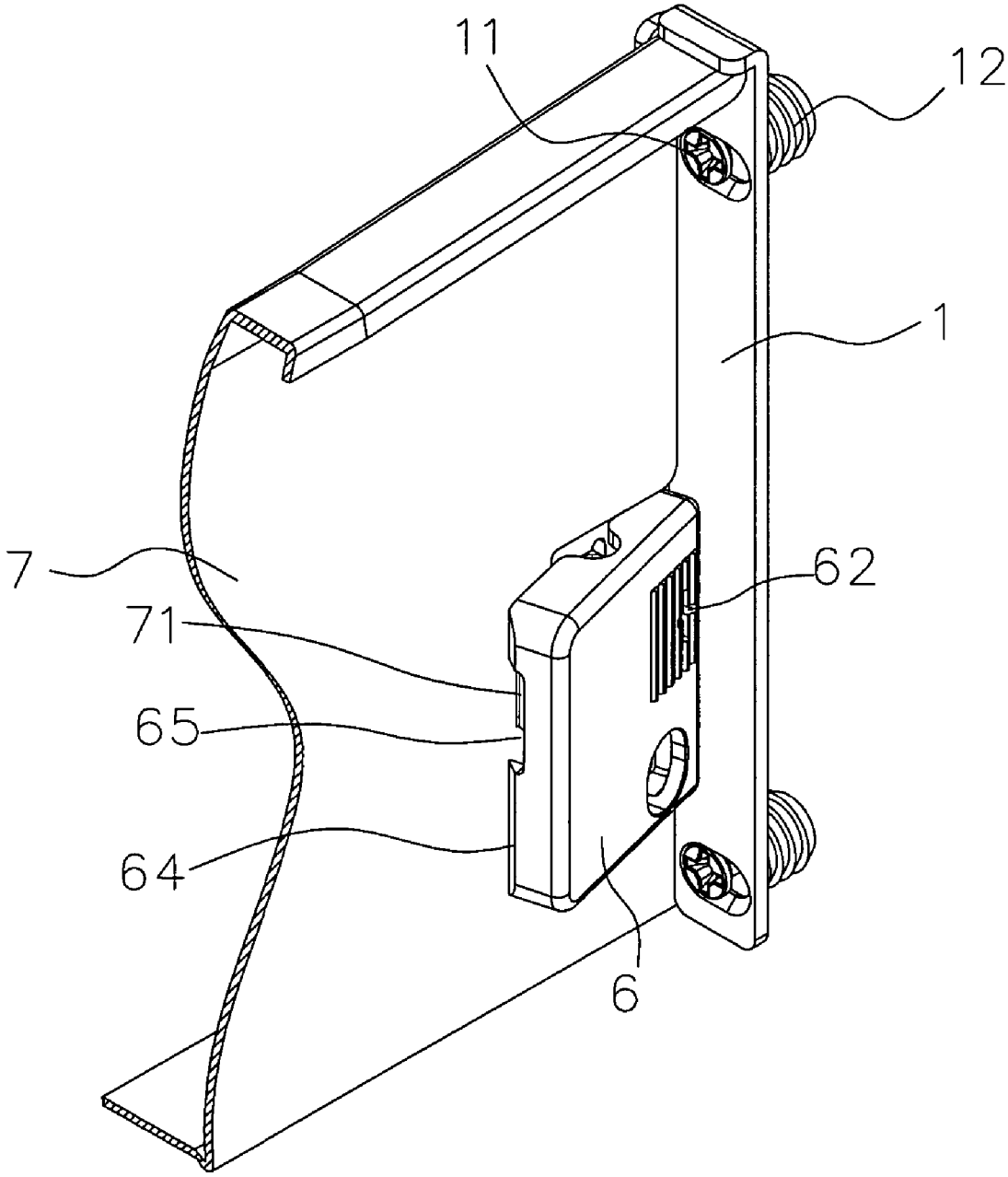
FIG. 4 is a schematic view of the embodiment of the invention in another assembly condition.
Figure 5:
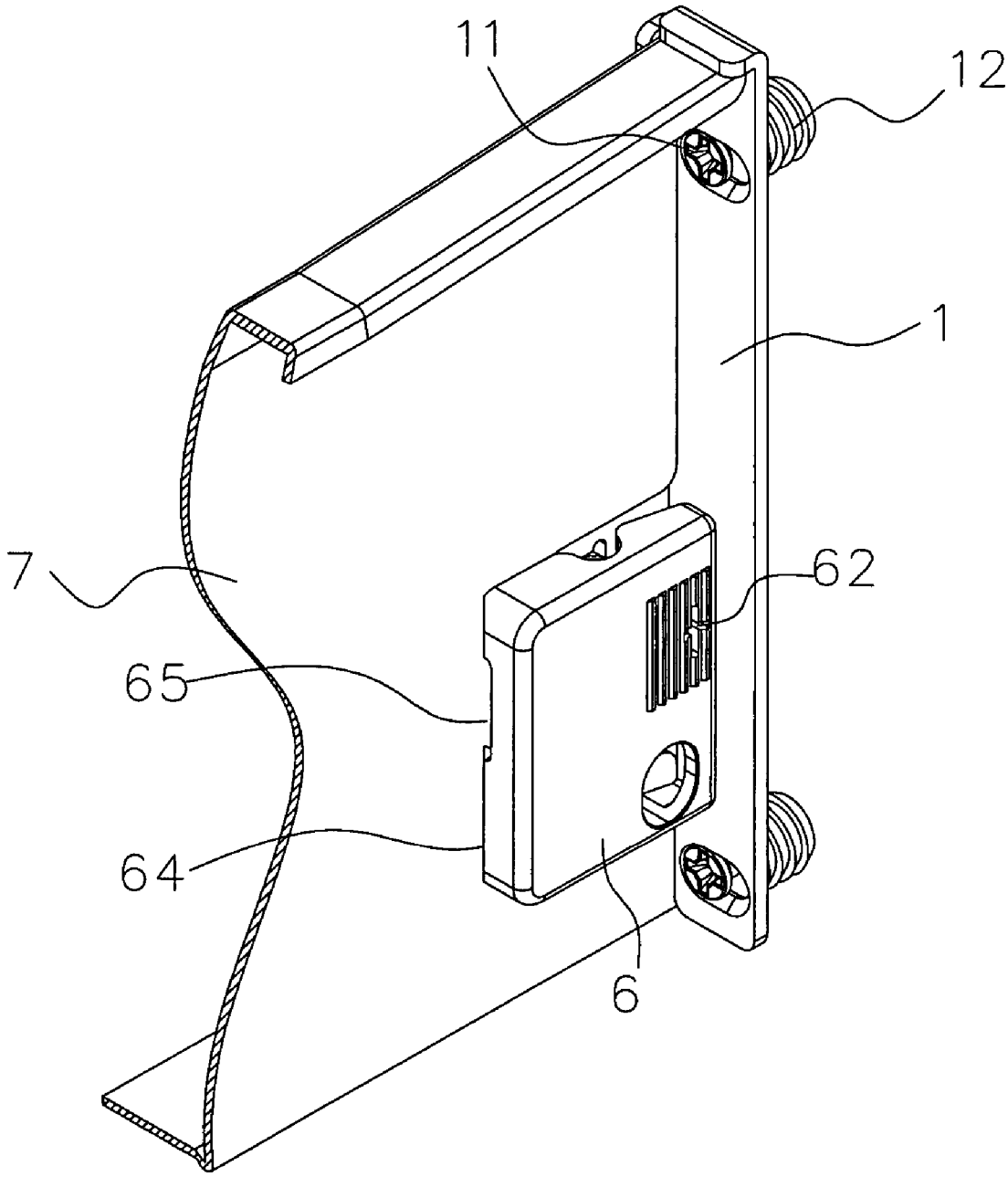
FIG. 5 is a schematic view of the embodiment of the invention in yet another assembly condition.

Assembly of the invention is performed manually. Referring to FIG. 3, insert a hand tool such as a blade screwdriver into the tool notch 62 on the clip frame 6, where the levering force is applied to pry and open the clamped side. This approach may also be used to disassemble the clip frame 6 and the base plate 2. Referring to FIG. 4, the opening side of the clip frame 6 and the base plate 2 is coupled with the side panel 7 at the second notch 72. After releasing the hand tool, the clip frame 6 and the base plate 2 automatically close and clamp the side panel 7 to form anchoring (referring to FIG. 5). On the other hand, machines may also perform the assembly set forth above automatically. The sloped guiding edge 64 of the clip frame 6 allows the side panel 7 to wedge in by force. And the arched edge 631 at the front side of the stopping flange 63 can directly slide over the ridge 71 of the side panel 7 so that the clip frame 6 and the base plate 2 can clamp the side panel 7 of the drawer. The stopping flange 63 can latch on the ridge 71 to form an anchoring condition vertically and horizontally.

What is claimed is:

1. A drawer having a side panel and a face panel coupled by a coupling apparatus, comprising:

a longitudinal panel which has two ends, each end fastening to said face panel of said drawer along one surface of said longitudinal panel;

a base plate formed by bending and extending from one side of the longitudinal panel having first pivot lugs for receiving a pin and coupling with a torsional spring; and a clip frame corresponding to the base plate having second pivot lugs corresponding to the first pivot lugs to pivotally couple with the base plate and a stopping flange formed on an inner side of the clip frame, the torsional spring being coupled with the base plate and the clip frame and providing an elastic force to the clip frame and the base plate so that a side of the clip frame and the base plate which pivots to be open, is closed and clamped by the elastic force;

wherein the side panel has a first notch corresponding to the first pivot lugs and the second pivot lugs, and a ridge formed by stamping corresponding to and latchable on the stopping flange in the clamped condition, the clip frame and the base plate automatically clamping and coupling the side panel to the face panel after the clip frame has been pried open and the side panel inserted thereto.

2. The drawer of claim 1, wherein the clip frame has a tool notch on an outer side of the clip frame that is subject to an inverse levering force.

3. The drawer of claim 1, wherein the stopping flange has an arched edge on a front side and a sloped guiding edge on a lateral side of the clip frame, the lateral side having a nick corresponding to the stopping flange.

4. The drawer of claim 1, wherein the side panel has a second notch and the clip frame has a turning knob with a cam corresponding to the second notch.

* * * * *